US006509521B1

(12) United States Patent
Geitz

(10) Patent No.: US 6,509,521 B1
(45) Date of Patent: Jan. 21, 2003

(54) X-RAY CATHETER WITH COAXIAL CONDUCTOR

(75) Inventor: Kurt Alfred Edward Geitz, Sudbury, MA (US)

(73) Assignee: Scimed Life Systems, Inc., Maple Grove, MN (US)

( * ) Notice: Subject to any disclaimer, the term of this patent is extended or adjusted under 35 U.S.C. 154(b) by 100 days.

(21) Appl. No.: 09/709,662

(22) Filed: Nov. 10, 2000

(51) Int. Cl.[7] ..... H01B 7/00
(52) U.S. Cl. ..... 174/28; 174/36
(58) Field of Search ..... 174/36, 28, 102 R, 174/102 C, 107; 333/239

(56) References Cited

U.S. PATENT DOCUMENTS

| | | | | | |
|---|---|---|---|---|---|
| 2,740,095 | A | * | 3/1956 | Somes | 333/96 |
| 3,248,473 | A | * | 4/1966 | Buhmann | 174/107 |
| 3,541,221 | A | * | 11/1970 | Aupoix et al. | 174/13 |
| 4,599,483 | A | * | 7/1986 | Kuhn et al. | 174/103 |
| 4,641,649 | A | | 2/1987 | Walinsky et al. | 128/303.1 |
| 4,652,846 | A | | 3/1987 | Sobottka | 336/84 C |
| 4,810,834 | A | * | 3/1989 | Grogi et al. | 174/121 R |
| 4,860,744 | A | | 8/1989 | Johnson et al. | 128/303.1 |
| 4,993,404 | A | | 2/1991 | Lane | 128/4 |
| 5,006,119 | A | | 4/1991 | Acker et al. | 606/27 |
| 5,041,107 | A | | 8/1991 | Heil, Jr. | 604/891.1 |
| 5,043,530 | A | * | 8/1991 | Davies | 174/102 R |
| 5,084,061 | A | | 1/1992 | Gau et al. | 606/195 |
| 5,127,394 | A | | 7/1992 | Lane | 128/4 |
| 5,151,100 | A | | 9/1992 | Abele et al. | 606/28 |
| 5,230,349 | A | | 7/1993 | Langberg | 128/786 |
| 5,298,682 | A | * | 3/1994 | Salz | 174/105 R |
| 5,354,220 | A | | 10/1994 | Ganguly et al. | 439/675 |
| 5,372,603 | A | | 12/1994 | Acker et al. | 606/194 |
| 5,542,928 | A | | 8/1996 | Evans et al. | 604/113 |
| 5,562,633 | A | | 10/1996 | Wozencroft | 604/171 |
| 5,566,221 | A | | 10/1996 | Smith et al. | 378/145 |
| 5,591,162 | A | | 1/1997 | Fletcher et al. | 606/25 |
| 5,593,524 | A | * | 1/1997 | Philips | 156/244.12 |
| 5,599,346 | A | | 2/1997 | Edwards et al. | 606/41 |
| 5,704,914 | A | | 1/1998 | Stocking et al. | 604/164 |
| 5,718,688 | A | | 2/1998 | Wozendroft | 604/164 |
| 5,782,740 | A | | 7/1998 | Schneiderman | 600/1 |
| 5,793,272 | A | | 8/1998 | Burghartz et al. | 336/200 |
| 5,795,339 | A | | 8/1998 | Erskine | 604/264 |
| 5,816,999 | A | | 10/1998 | Bischoff et al. | 600/3 |
| 5,865,806 | A | | 2/1999 | Howell | 604/164 |

FOREIGN PATENT DOCUMENTS

| | | | | |
|---|---|---|---|---|
| DE | 1904161 A | * | 10/1969 | |
| JP | 363291309 A | * | 11/1988 | H01B/11/18 |
| WO | 97/07740 | | 3/1997 | |
| WO | 98/48899 | | 11/1998 | |
| WO | 00/09212 | | 2/2000 | |

* cited by examiner

*Primary Examiner*—Dean A. Reichard
*Assistant Examiner*—William H. Mayo, III
(74) *Attorney, Agent, or Firm*—Fulbright & Jaworski L.L.P.

(57) ABSTRACT

A coaxial cable (coax) has successive layers of a hollow non-conductive inner core, a conductive inner layer, an insulating layer, a conductive outer layer, and a non-conductive outer layer.

5 Claims, 1 Drawing Sheet

X-RAY CATHETER WITH COAXIAL CONDUCTOR

BACKGROUND OF THE INVENTION

1. Field of the Invention

The difficulty of generating x-rays in a miniaturized x-ray unit lies in delivering the amount of energy, typically 10,000 to 60,000 volts to the miniaturized x-ray source down a conductive element to the source. These high voltages present many difficulties, which are overcome by the coaxial conductor of the present invention.

2. Description of the Related Art

Traditionally, x-rays have been used in the medical industry to view bone, tissue and teeth. X-rays have also been used to treat cancerous and precancerous conditions by exposing a patient to x-rays using an external x-ray source. Treatment of cancer with x-rays presents many well documented side effects, many of which are due to the broad exposure of the patient to the therapeutic x-rays.

Minimally invasive endoscopic techniques have been developed and are used to treat a variety of conditions. Endoluminal procedures are procedures performed with an endoscope which is a tubular device inserted into the lumen wherein a variety of rigid or flexible tools are inserted therein to treat or diagnose a patient's condition.

The desire for improved minimally invasive medical devices and techniques have led to the development of miniaturized x-ray devices that may be used in the treatment or prevention of a variety of medical conditions. International Publication No. WO 98/48,899 describes a miniature x-ray unit having an anode and cathode separated by a vacuum gap positioned inside a metal housing. The anode includes abase portion and a projecting portion. The x-ray unit is insulated and connected to a coaxial cable which, in turn, is connected to the power source. An x-ray window surrounds the projecting portion of the anode and the cathode so that the x-rays can exit the unit. The x-ray unit is sized for intra-vascular insertion, and may be used, inter alia, in vascular brachytherapy of coronary arteries, particularly after balloon angioplasty.

International Publication No. WO 97/07,740 describes an x-ray catheter having a catheter shaft with an x-ray unit attached to the distal end of the catheter shaft. The x-ray unit comprises an anode and a cathode coupled to an insulator to define a vacuum chamber. The x-ray unit is coupled to a voltage source via a coaxial cable. The x-ray unit can have a diameter of less than 4 mm and a length of less than about 15 mm, and can be used in conjunction with coronary angioplasty to prevent restenosis.

U.S. Pat. No. 5,006,119 describes a hollow core coaxial catheter supporting a heatable probe or balloon and transmitting electrical power, such as radio frequency (RF) RF energy, to the ohmically resistive probe or balloon. The hollow core may accommodate passage of a guide wire, fiber optics for imaging or laser, fluid flow for profusion and/or a lumen for fluid inflation and pressurization of a balloon. Inner and outer electrical conductors are disposed on radially opposite sides of dielectric tubing with an outer covering of dielectric material mechanically shielding and electrically insulating the outer conductor. A similar inner covering of dielectric material may be disposed radially inwardly of the inner conductor to mechanically and electrically insulate the inner conductor. An ohmically resistive load, wherein RF energy is the power source, interconnects the inner and outer conductors to form a probe. An inflatable balloon of predetermined expanded configuration and inflatable via the lumen may be formed approximate or as a part of the probe to expand arterial plaque heated by the probe or to heat and expand arterial plaque to a predetermined configuration. The RF energy, if used, will heat the probe or balloon, and monitor and manage the temperature of the probe or the balloon. U.S. Pat. No. 5,372,603 describes a method of using this hollow coaxial catheter to perform angioplasty.

U.S. Pat. No. 5,354,220 describes an electrical connector for use in connecting an ultrasonic transducer to a coaxial cable running through a catheter. The transducer is normally disposed at a distal end of the catheter and is removably attached to and supported by the electrical connector. The connector includes a plastic collar, and a pair of cylindrical flexible conductive ring clips. Enlarged rims on the ring clips are molded into the connector in coaxial alignment, and the ring clips are spaced apart-from each other by a distance that corresponds to the thickness of the cylindrical transducer, but are slightly closer together at the projecting ends. Each ring clip includes a plurality of circumferentially spaced-apart slots to define a plurality of fingers, adding flexibility to the ring clips. One of the ring clips is electrically connected to a grounding shield of the coaxial cable and the other is electrically connected to an internal conductor of the cable.

U.S. Pat. No. 4,641,649 describes a medical procedure for treating tachycardia or cardiac disrhythmia and uses a catheter having a flexible coaxial transmission line (coax) terminated by an antenna. The antenna and coax are introduced into a chamber of the heart. The antenna is brought into contact with the wall of the heart. Action potentials generated by the heart are coupled through the antenna and the coaxial cable to a standard electrocardiograph apparatus for display. Other electrodes placed about the body also produce action potentials that are displayed by the electrocardiograph. The position of the antenna in the chamber of the heart is adjusted with the aid of the displayed action potentials until the antenna is in contact with the region to be ablated or injured as indicated by its characteristic electrical signature. When the antenna is adjacent to or in contact with the desired region or location, radio frequency or microwave frequency electrical energy is supplied to the proximal end of the coax and applied to the desired location via the coax and the antenna. The action potentials may be viewed while the electrical energy is applied to the desired location. The power of the electrical energy can be slowly increased until the desired amount of blockage of the bundle of HIS or damage to the ectopic focus has been achieved.

Miniaturized x-rays are not foolproof, however, and still present difficulties. The x-ray unit generates heat, which can damage adjacent tissue. Additionally, x-rays are not localized and irradiate local tissue rather than only irradiating the desired site. Also, it is difficult to maintain the positioning of these instruments inside at the desired location. Improved miniaturized x-ray units that overcome these difficulties are desirable.

Other techniques are used to treat tumors with x-rays, including planting a seed of radioactive material at the tumor site, typically accomplished with endoluminal procedures. However, the patient becomes "hot", i.e., radioactive, and the procedure risks exposure of the medical personnel to radiation exposure.

As noted above, many types of cancerous and precancerous conditions are treated by irradiating the tumor or site with x-rays. However, the x-rays are broadcast over a large area of healthy tissue in addition to the tumor, since the radiation is administered from outside the body so that it penetrates the skin and any internal organs or tissue to reach the desired site. To avoid this, miniaturized x-ray systems which generate x-rays at the desired site are a desirable alternative to conventional apparatus.

Many types of cancer occur in a body cavity or lumen, such as in the rectum, vagina, esophagus or pulmonary passages. It would be desirable to treat these cancers using miniaturized x-ray sources in combination with endoscopic techniques, which are minimally invasive to the patient, so that the cancer or other intraluminal tissue is directly treated with x-rays. This technique would minimize exposure of health tissues to the x-rays.

SUMMARY OF THE INVENTION

The present invention overcomes the difficulties associated with x-ray therapy and apparatus of the prior art by providing an endoscopic x-ray device that generates x-rays at the site of treatment and minimizes exposure of other tissues to irradiation.

An advantage of the coaxial cable of the invention is a reduced wire size allowing for minimization of the overall apparatus for medical use. Alternatively, a large gauge insulated wiring could be used to distributed the high voltages required; however, the large gauge wire is very cumbersome, takes up much more space than the coaxial cable of the present invention, and is much less flexible than the coaxial cable of the present invention, which would lead to difficulties in manipulating the catheter inside a body lumen.

Since the outer conductor of the coaxial cable of the present invention is attached to electrical ground and covered with a non-conductive covering, electrical short circuits, if they occurred, are contained within the catheter, protecting the patient from electric shock. A further advantage is that the concentric construction of this conductor is very space efficient while at the same time provides a large current conducting area which leads to a low electrical resistance, increasing efficiency. A further advantage is that the layered construction, as noted above, provides good flexibility and yet maintains good column strength, thus preventing the possibility of breakage during use.

DETAILED DESCRIPTION OF THE INVENTION

Figure 1:
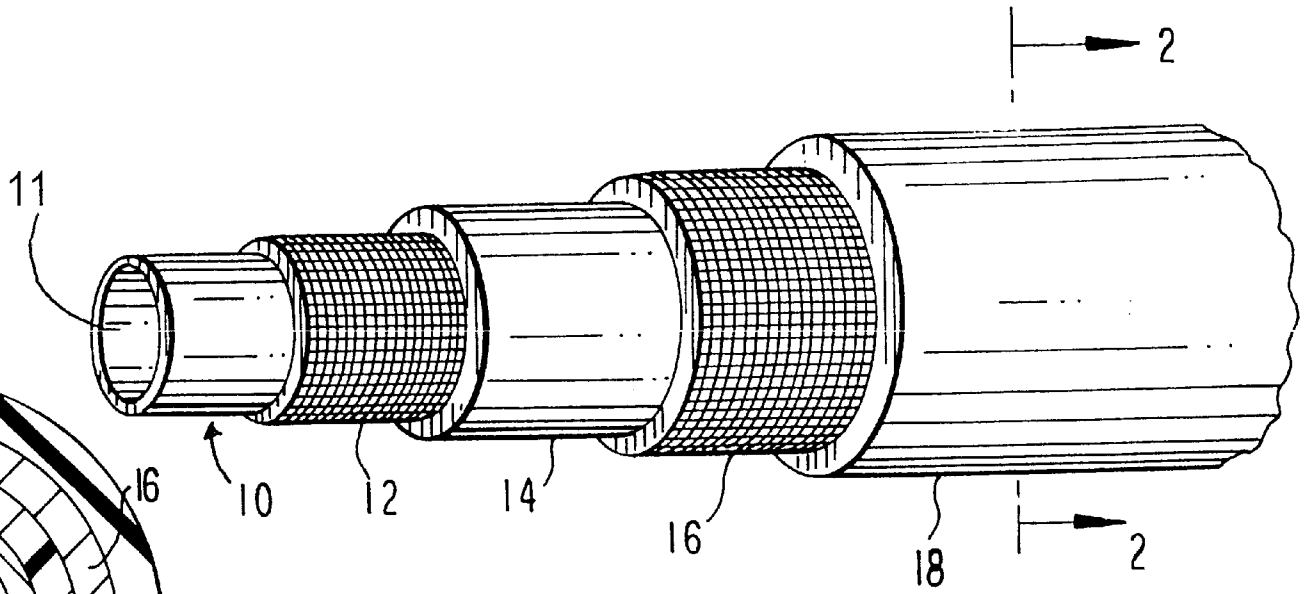
FIG. 1 is an exploded view of the coaxial conductor of the invention, with layers successively shown as cutaways from the outer cover to the inner hollow tube.
Figure 2:
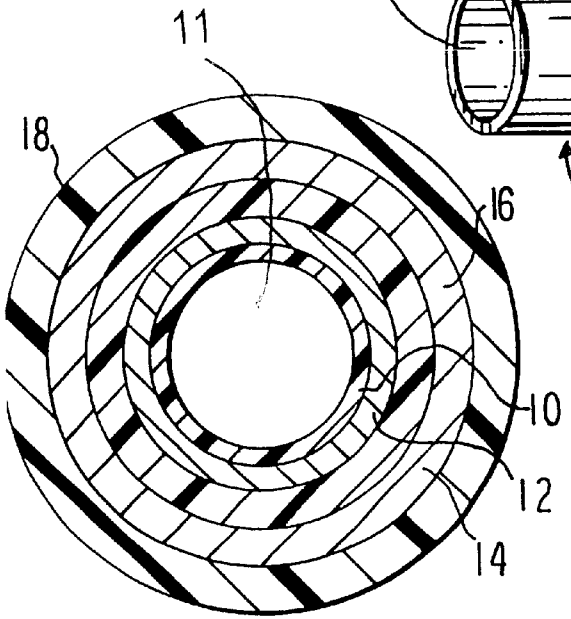
FIG. 2 is a cross section of the coaxial cable of the invention.

The catheter body of the present invention is designed to deliver the high voltages necessary to a miniaturized x-ray source in an x-ray tube. Miniaturized x-ray sources have been described in the literature. The coaxial cable of the present invention includes, layered from the inside out, a non-conductive hollow inner tube 10, an inner conductive sheath 12, an insulating layer 14, an outer conductive sheath 16, and a non-conductive outer cover 18. These layers run concentrically through the entire length of the catheter, but are shown in FIG. 1 in successive cutaway views to aid the reader.

The basic construction of the coaxial cable of the present invention as concentric conductors with concentric insulating layers is similar to presently known coaxial electrical cables except that standard coaxial electrical cables have a solid inner conductor rather than the hollow inner tube and inner conductive sheath of the coaxial catheter body of the present invention. The hollow inner tube is made of a non-conductive material which also acts as an insulator. The hollow inner tube has an inner lumen 11 and is constructed of a material suitable for the purpose, for example, a non-conductive heat resistant plastic. Inner conductive sheath 12 surrounds hollow inner tube 10. Inner conductive sheath 12 is made of a latticework of conductive metal elements or wires which form a crisscross pattern one over the other and are embedded in a suitable insulated material and together therewith form the inner conductive sheath. Insulating layer 14 surrounds the inner conductive sheath and forms a barrier between sheath 12 and outer conductive sheath 16, which can be made of the same material as the inner conductive sheath except that it is of a larger diameter to surround insulating layer 14 which in turn surrounds inner conductive sheath 12 which itself surrounds the inner hollow tube 10. Outer cover 18 is made of an insulating material which may be the same as the material from which the hollow inner tube 10 is constructed. Outer cover surrounds and contacts the outer conductive sheath 16.

The coaxial electrical cable is made by alternating extrusions of a non-conductive polymer, such as nylon, and the conductive sheaths comprised of either braided wire, coil or metallic foil. Braided coil coaxial are preferred because they provide excellent catheter properties, including flexibility and column strength.

The inner and outer, conductive sheets of the catheter body distribute high voltages down the length of the coaxial catheter. Outer conductive sheath 16 is attached to an electrical ground (not shown) while inner conductive sheath 12 is connected to a positive DC voltage potential located, in use, outside of the patient. Together, the inner conductive sheath and the outer conductive sheath provide power to electronic x-ray source (not shown) located at the distal tip of the catheter. Lumen 11 inside hollow inner tube 10 can be used as an access site to pass any number of endoscopic aids such as guide wires, irrigation fluids, suction, chemotherapeutic agents, diagnostic agents or other aids into the treatment area within the body lumen in which the catheter is inserted.

The coaxial cable of the present invention may be used with any number of apparatus in which high voltages are required to be distributed over relatively large lengths. For example, the coaxial cable of the present invention could be used in any application wherein an endoluminal device requires a large distribution power over its length.

Other embodiments of the invention will be readily apparent to those skilled in the art, and are intended to be within the scope and spirit of the invention.

I claim:

1. A coaxial cable comprising:

a hollow non-conductive inner core having an outer wall;

an inner conductive sheath surrounding the outer wall of said hollow non-conductive inner core, said inner conductive sheath comprising a latticework of conductive metal elements embedded in an insulated material;

an insulating layer surrounding said inner conductive sheath;

an outer conductive sheath surrounding said insulating layer;

and a non-conductive outer layer.

2. The x-ray catheter of claim 1, wherein said inner conductive sheath is connected to a positive DC voltage source.

3. An apparatus comprising the coaxial cable of claim 1.

4. The coaxial cable of claim 1, wherein said outer conductive sheath comprises a latticework of conductive metal elements embedded in an insulated material.

5. The coaxial cable of claim 1, wherein said inner and outer conductive sheaths are made of the same material.

* * * * *